US008708337B2

(12) United States Patent
Thompson et al.

(10) Patent No.: US 8,708,337 B2
(45) Date of Patent: Apr. 29, 2014

(54) DUAL FLIP OVER ROLL INVERTER

(71) Applicant: Xerox Corporation, Norwalk, CT (US)

(72) Inventors: Bruce Allen Thompson, Fairport, NY (US); Frank Albert Porter, Penfield, NY (US); Michael J. Linder, Walworth, NY (US); William Matthew Harney, Rush, NY (US); Robert Rinefierd, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/629,735

(22) Filed: Sep. 28, 2012

(65) Prior Publication Data

US 2014/0091515 A1 Apr. 3, 2014

(51) Int. Cl.
*B65H 5/00* (2006.01)

(52) U.S. Cl.
USPC ..... 271/225; 271/184; 271/185; 271/186

(58) Field of Classification Search
CPC ..... B65H 2301/33; B65H 2301/332; B65H 2301/333; B65H 2301/3312
USPC ..... 271/225, 184, 185, 186
See application file for complete search history.

(56) References Cited

U.S. PATENT DOCUMENTS

| | | | | |
|---|---|---|---|---|
| 4,871,163 | A * | 10/1989 | Landa et al. | 271/225 |
| 6,203,007 | B1 * | 3/2001 | Choi | 271/278 |
| 7,093,831 | B2 * | 8/2006 | Biegelsen et al. | 271/184 |
| 7,185,888 | B2 * | 3/2007 | Duff et al. | 271/303 |
| 7,841,594 | B2 * | 11/2010 | Janatka et al. | 271/184 |
| 7,885,592 | B2 * | 2/2011 | Schmitz et al. | 399/329 |
| 8,087,668 | B2 * | 1/2012 | Taniguchi | 271/225 |

* cited by examiner

*Primary Examiner* — Kaitlin Joerger
(74) *Attorney, Agent, or Firm* — Hoffmann & Baron, LLP

(57) ABSTRACT

Provided herein is sheet inverter apparatus which includes a diverter gate which diverts the sheet to one of at least two paths, a first paper path, and a second paper path. The first and second path each include a rotatable nip assembly, the rotatable nip assembly including a nip drive roll and a nip idler roll positioned so as to define a nip therebetween, the nip serving as a rotatable axis around which the nip drive roll and the nip idler roll rotate to invert the sheet.

12 Claims, 3 Drawing Sheets

DUAL FLIP OVER ROLL INVERTER

FIELD OF THE INVENTION

The present invention generally relates to document processing devices and methods for operating such devices. More particularly, the present invention relates to inverters for a document processing device.

BACKGROUND OF THE INVENTION

Inverters are known in the prior art for use with printmaking devices, particularly to invert a sheet of paper along a feed path. This allows for various operations, including front and back printing. Commonly, tri-roll inverters are used, such as that disclosed in U.S. Pat. No. 5,265,864 to Roux et al. With a tri-roll inverter, paper is introduced through a first nip of a tri-roll arrangement and fed into a reversing nip. The reversing nip accepts the sheet of paper moving in a first direction, causes the sheet of paper to stop and then drive the paper in a second direction, opposite that from the first direction. Upon being driven in the reverse direction, the sheet of paper is caused to pass through a second nip of the tri-roll arrangement. This allows for a sheet of paper to be flipped in orientation relative to the feed path.

With ever increasing volumes and velocities with printmaking devices, speed of handling paper at particular processes becomes a limiting factor. With a tri-roll arrangement, the need to accelerate the reversing nip in one direction, stopping and causing reverse movement provides a limiting factor as to the number of sheets per time intervals that can be handled through this arrangement. Although rapid servo motors and controls are available, the tri-roll inversion process can only be sped up to a certain level.

SUMMARY OF THE INVENTION

A sheet inverter apparatus is provided herein which includes a diverter gate which diverts the sheet to one of at least two paths, a first paper path, and a second paper path. The first path includes a first rotatable nip assembly, the first rotatable nip assembly includes a first nip drive roll and first nip idler roll positioned so as to define a first nip therebetween, the first nip serving as a rotatable axis around which the first nip drive roll and the first nip idler roll rotate to invert the sheet.

The sheet inverter apparatus further includes a second path, which includes a second rotatable nip assembly, the second rotatable nip assembly including a second nip drive roll and a second nip idler roll positioned so as to define a second nip therebetween. The second nip also serves as a rotatable axis around which the second nip drive roll and the second nip idler roll rotate to invert the sheet.

In another embodiment, the sheet inverter apparatus also includes an exit nip assembly, the exit nip assembly including an exit nip drive roll and an exit nip idler roll positioned so as to define an exit nip therebetween. In an embodiment, the diverter gate of the sheet inverter apparatus alternately directs sheets to the first path and the second path.

In an embodiment, the first rotatable nip assembly and the second rotatable nip assembly are mounted on a movable frame. The first nip assembly further is powered by a first rotation motor, and the second nip assembly is controlled by a second rotation motor, each of which independently actuates rotation of the respective nip assemblies.

In another embodiment, the first nip drive roll is controlled by a first drive motor, and the said second nip drive roll is controlled by a second drive motor, where the drive motors are independent of the rotations motors. The first path and second path are each receptively positioned to receive a sheet of paper from the diverter gate, and the first path and said second path are also each positioned to feed paper to the exit nip assembly.

In an embodiment, the sheet inverter apparatus can invert at least about 225 pages per minute. Preferably the sheet inverter apparatus can invert at least about 250 pages per minute.

In another embodiment, a third and/or fourth path may be present with third and fourth rotatable nip assemblies, respectively. The diverter gate may alternately divert sheets of paper to the first, second, and third paths, or to the first second, third, and fourth paths.

In another embodiment, the present invention includes a document processing device. The document processing device includes a sheet inverter, which includes a diverter gate which directs a sheet to a first path or a second path. The first path includes a first rotatable nip assembly, the first rotatable nip assembly including a first nip drive roll and first nip idler roll positioned so as to define a first nip therebetween, the first nip also serving as a rotatable axis around which the first nip drive roll and the first nip idler roll rotate to invert the sheet of paper.

The second path includes a second rotatable nip assembly, the second rotatable nip assembly including a second nip drive roll and a second nip idler roll positioned so as to define a second nip therebetween, the second nip also serving as a rotatable axis around which the second nip drive roll and the second nip idler roll rotate to invert the sheet of paper. The document processing device further includes a paper feed path positioned to direct paper into the inverter, and a paper outlet path, spaced from the paper feed path, ad positioned to receive paper from the inverter, and forward to a next stage in the document processing process.

DETAILED DESCRIPTION

Figure 1:
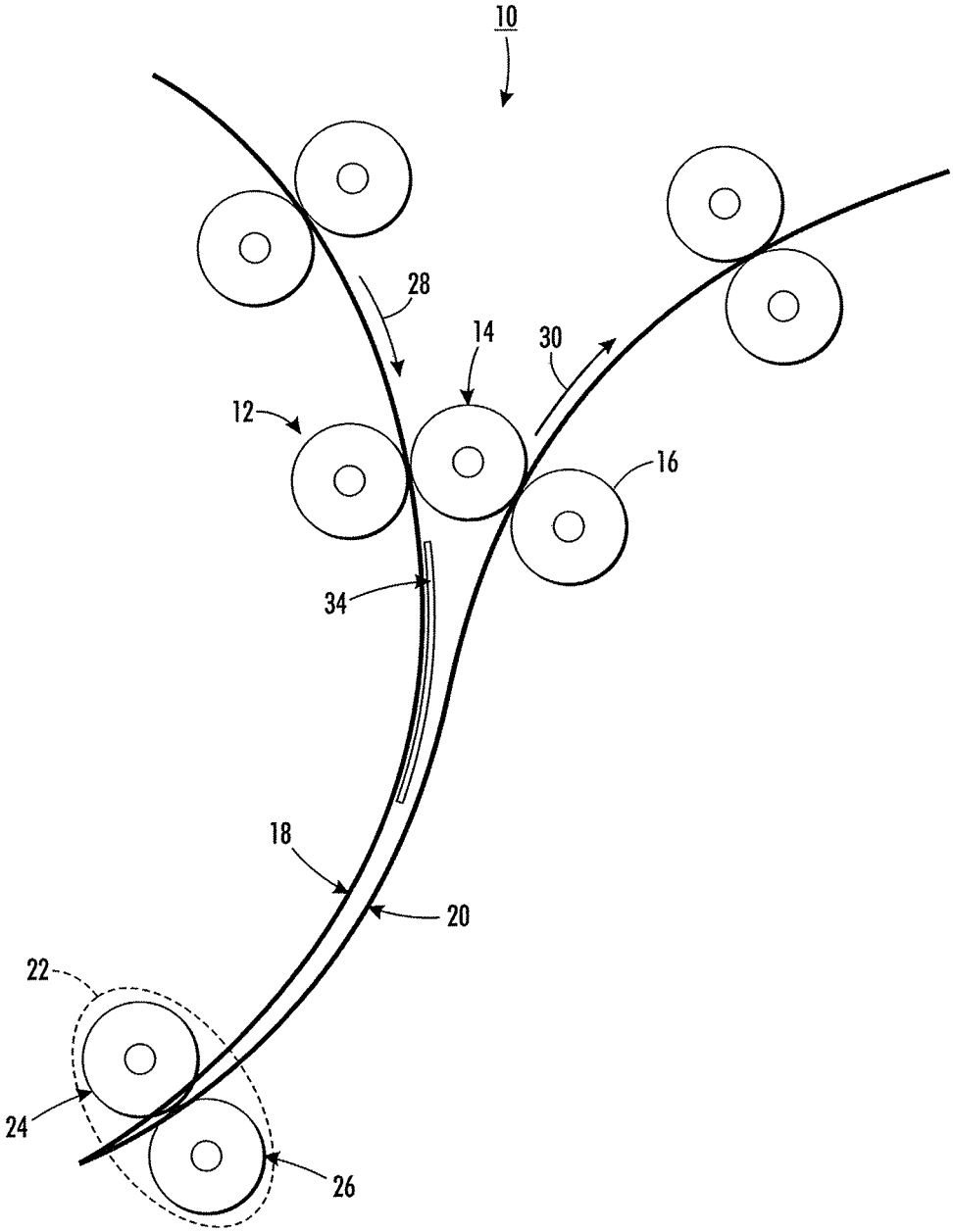
FIG. 1 is a schematic side view of a prior art tri-roll inverter.

The following terms shall have, for the purposes of this application, the respective meanings set forth below.

A "document processing device" refers to a device that performs an operation in the course of producing, replicating, or transforming a document from one format to another format, such as from an electronic format to a physical format or vice versa. Document processing devices may include, without limitation, printers (using any printing technology, such as xerography, ink jet, or offset); document scanners or specialized readers such as check readers; mail handling machines; fabric or wallpaper printers; or any device in which an image of any kind is created on and/or read from a moving substrate.

A "substrate of media" refers to, for example, paper, transparencies, parchment, film, fabric, plastic, or other substrates on which information can be reproduced, for example, in the form of a sheet or web.

A "nip" refers to a location in a document processing device at which a sheet is propelled in a process direction. A nip may be formed between an idler wheel and a drive wheel.

A "nip assembly" refers to components, for example and without limitation, a nip drive roll and a nip idler roll which form a nip.

A "drive roll" refers to a nip assembly component that is designed to propel a sheet in contact with the nip. A drive roll may include a wheel, roller or other rotatable member. The drive roll may have an outer surface including a compliant material, such as rubber, neoprene or the like. The drive roll may be directly driven via a stepper motor, a DC motor or the like. Alternately, a drive roll may be driven using a gear train, belt transmission or the like.

An "idler roll" refers to a nip assembly component that is designed to provide a normal force against a sheet in order to enable the sheet to be propelled by the drive roll. An idler roll may include a wheel, roller or other rotatable member. The idler roll may have an outer surface including a non-compliant material, such as plastic.

Provided herein is an improved dual flip-over roll inverter used to invert a substrate of media in a document processing device. Preferably, a sheet inverter is provided including two parallel inverters, which work via rotatable nip assemblies. Advantageously, the inverter provides increased throughput for a document processing device without an increase in sheet velocity or acceleration. The inverter can work at the corresponding speed of the sheet through the rest of the document processing device, e.g., a linear speed of 1060 mm/sec and suitable account for typical accelerations within the document processing device; e.g., 2 g acceleration.

Because the rotatable nip assemblies are mounted on a movable assembly, it provides for increased efficiency since the movement of the assembly can be used to correspond to the relative motion of the sheet in the machine space. Each nip assembly serves as a reversing roll inverter, but having multiple nip inverters enables parallel processing which improves throughput speed.

Additionally, the present invention is less expensive to produce than the prior art such as a reversing roll or a tri nip inverter. The dual flip over roll inverter of the present disclosure further provides for a document processing device with a smaller machine footprint. Still further, the design of such document processing devices utilizing the multiple nip inverter allows for modularization of the design more so than the prior art.

Still further, because inversion of the sheet is being accomplished at lower velocity and accelerations as compared to the stationary reversing roll inverters, the substrates, or printing sheets suffer from less image abrasion on solid ink copies.

With reference now to FIG. 1 of the drawings, the known tri-roll inverter 10 of the prior art is shown. Such a tri-roll inverter is used, for example, in the Xerox 5100®, and includes an input nip formed by rollers 12 and 14 and an output nip formed between rollers 14 and 16, collectively a tri-nip roll. Input and output baffles 18 and 20 guide copy sheets into and out of the inverter. A corrugation system or reversing system 22 includes a nip formed between rollers 24 and 26 which corrugates copy sheets entering the nip as they are driven by the input nip in the direction of arrow 28 and as the copy sheets are driven out of the inverter in the direction of arrow 30. Upon entry of the lead edge of a copy sheet 34, the copy sheet is propelled into the corrugator driver 26 of corrugation system. The copy sheet follows the baffle into the corrugator, where there is force applied throughout the remaining length of the copy sheet. This decreases the speed of the copy sheet. When the trail edge of the copy sheet clears the tri-roll input nip, the corrugator roller 26 slows the sheet to a stop, reverses the motor direction, accelerates the sheet back to the tri roll velocity, then delivers the sheet to the tri roll output path. It then slows down and stops after the tail end of the outgoing sheet has cleared the corrugating roll, reverses direction and accelerates up to the tri roll velocity to accept the next sheet. In order to achieve 250 papers per minute (ppm), the cycle time for this to happen is only 240 milliseconds. Each of these events happens serially and therefore the sheet velocities and accelerations required for this style of inverter are very high and would cause concern for sheet damage and jams. Solid ink images are particularly susceptible to corruption in this process.

The acceleration rates required by the reversing (or corrugating) roll can be estimated as a function of the tri roll velocity. At a tri roll velocity equal to the transfix roll velocity (1060 mm/sec), the reversing roll must accelerate/decelerate at a rate of 5.96 g's to maintain a 250 page per minute rate. If the tri roll velocity increases, this creates more of an inter document gap between the sheets and hence more time to accelerate and decelerate. Diminishing returns exist. Furthermore, going faster than approximately 1600 mm/second with an acceleration/deceleration rate of 3.1 g's is difficult to accomplish.

Figure 2:
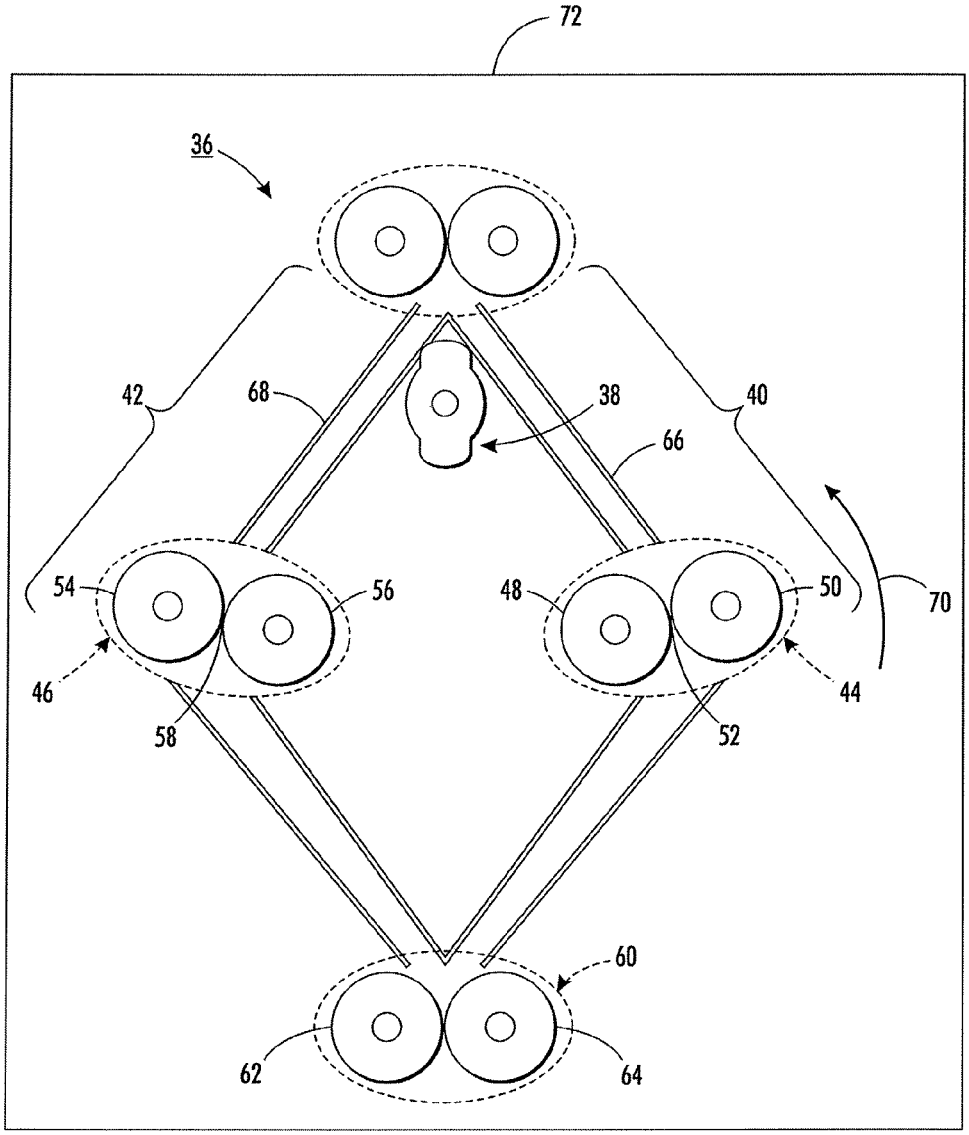
FIG. 2 is a schematic diagram of the dual flip-over inverter of the present invention.
Figure 3:
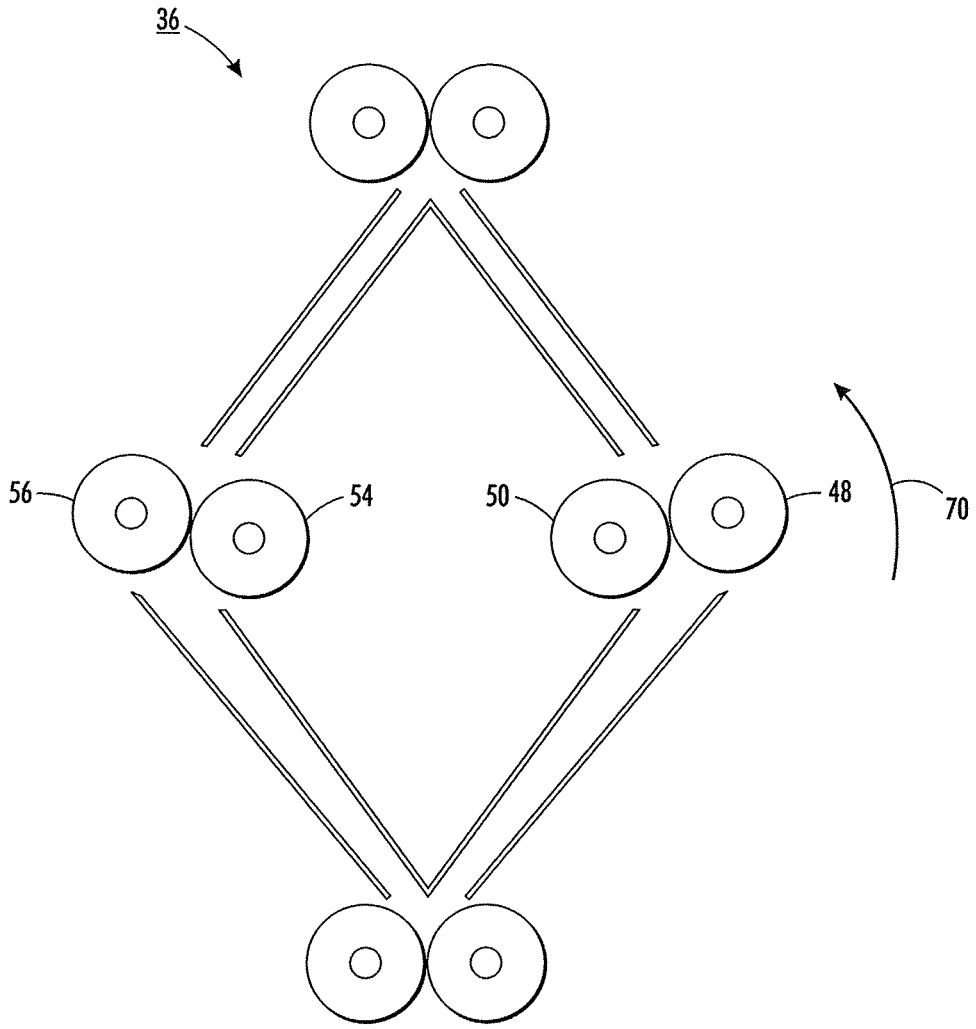
FIG. 3 is a schematic diagram showing a rotational position of the dual flip-over inverter of the present invention during its operation.

With reference to FIGS. 2 and 3, a sheet inverter apparatus 36 of the present invention is shown. The inverter 36 is used to invert a substrate of media in a document processing device 72, typically a sheet of paper. The sheet inverter apparatus 36 includes a diverter gate 38, first path 40, second path 42, the first and second paths including a first rotatable nip assembly 44 and second rotatable nip assembly 46, respectively. First path 40 includes a first paper pathway 66 which feeds a sheet of paper to the first rotatable nip assembly 44. Second path includes a second paper pathway 68 which feeds a sheet of paper to the second rotatable nip assembly 46.

First rotatable nip assembly 44 includes a first nip drive roll 48 and a first nip idler roll 50 defining a first nip 52 therebetween. First nip 52 serves as a rotatable axis around which the first nip drive roll 48 and first nip idler roll 50 rotate to flip a sheet of paper. Second rotatable nip assembly 46 includes a second nip drive roll 54 and a second nip idler roll 56 defining a second nip 58 therebetween. Second nip 58 serves as a rotatable axis around which the second nip drive roll 54 and second nip idler roll 56 rotate to flip a sheet of paper. The sheet inverter apparatus 36 further includes exit nip assembly 60. Exit nip assembly includes exit nip drive roll 62 and exit nip idler roll 64.

Each of the idler rolls may have an outer surface including a noncompliant material, such as hard plastic. Each of the drive rolls may include an outer surface having a compliant material such as rubber, neoprene or the like. The compliant material helps to grip the sheet and permit the drive roll to move the sheet through the nip. Each of the drive rolls rotates about a drive shaft and may be directly driven by a drive motor (not shown), such as a stepper motor, a DC motor or the like. A transmission device (also not shown) may extend between the drive motor and the drive roll for imparting motion to the drive roll. The transmission device may include a timing belt, gear trains or other transmission means known to those of ordinary skill in the art.

Diverter gate 38 alternately directs sheets of paper to first path 40 and second path 42 by methods well known in the art to create simultaneous paper inversion tracks, thereby increasing the ability of the inverter to handle increased volume of paper, such as is necessary in high speed printers or copiers.

In use, a first sheet of paper is fed to first paper feed path 40, as controlled by diverter gate 38. Each nip has a drive motor to drive the sheet and a motor to pivot the nip pair for inversion. As the first sheet of paper enters the first rotatable nip assembly 44, the first nip drive roll 48 drives the sheet into the first nip 52, then stops and slows down to hold the first sheet in the first nip 52. First rotatable nip assembly 44 then rotates in either a clockwise or counter-clockwise direction 70 to invert the first sheet of paper. After rotating in a counter-clockwise directions 70 fore example, first nip drive roll 48 and first nip idler roll 50 are positioned as shown in FIG. 3. First nip drive roll 48 then restarts in order to propel the first sheet of paper to exit nip assembly 60.

Similarly, second nip assembly 46 works in the same manner as first nip assembly. Second nip drive roll 54 and second nip idler roll 56 are therefore positioned as shown in FIG. 3 after rotation to invert a sheet of paper. Preferably the first path 40 and second path 42 can invert the sheet of paper simultaneously, then each rotatable nip assemblies can rotate to the receiving position as shown in FIG. 2.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A sheet inverter apparatus comprising:

a diverter gate which selectively directs a sheet to one of at least a first path and a second path;

a first rotatable nip assembly disposed along said first path, said first rotatable nip assembly including a first nip drive roll and a first nip idler roll positioned so as to define a first nip therebetween, a first axis passing through said first nip around which said first nip drive roll and said first nip idler roll rotate, a second rotatable nip assembly disposed along said second path, said second rotatable nip assembly including a second nip drive roll and a second nip idler roll positioned so as to define a second nip therebetween, a second axis passing through said second nip around which said second nip drive roll and said second nip idler roll rotate, wherein, said first path includes a first pathway for directing a sheet to said first rotatable nip assembly and a second pathway for receiving the sheet after passing through said first rotatable nip assembly, said first rotatable nip assembly being configured to rotate with a sheet engaged in said first nip so as to invert the sheet between said first pathway and said second pathway, wherein, said second path includes a third pathway for directing a sheet to said second rotatable nip assembly and a fourth pathway for receiving the sheet after passing through said second rotatable nip assembly, said second rotatable nip assembly being configured to rotate with a sheet engaged in said second nip so as to invert the sheet between said third pathway and said fourth pathway.

2. The sheet inverter apparatus of claim 1 further comprising an exit nip assembly, said exit nip assembly including an exit nip drive roll and an exit nip idler roll positioned so as to define an exit nip therebetween.

3. The sheet inverter apparatus of claim 1 wherein said diverter gate alternately directs sheets to said first path and said second path.

4. The sheet inverter apparatus of claim 1 wherein said first rotatable nip assembly and said second rotatable nip assembly are mounted on a movable frame.

5. The sheet inverter apparatus of claim 1 wherein said first rotatable nip assembly is controlled by a first rotation motor, and said second rotatable nip assembly is controlled by a second rotation motor.

6. The sheet inverter apparatus of claim 5 wherein said first nip drive roll is controlled by a first drive motor, and said second nip drive roll is controlled by a second drive motor, and wherein said first and second drive motors are independent of said first rotation motor and said second rotation motor.

7. The sheet inverter apparatus of claim 2 wherein said first path and second path are each receptively positioned to receive a sheet of paper from said diverter gate, and said first path and said second path are each positioned to feed paper to said exit nip assembly.

8. The sheet inverter apparatus of claim 1 wherein at least about 225 pages per minute can be inverted.

9. The sheet inverter apparatus of claim 1 wherein at least about 250 pages per minute can be inverted.

10. The sheet inverter apparatus of claim 1 further comprising a third path.

11. The sheet inverter apparatus of claim 10 further comprising a fourth path.

12. A document processing device comprising:

a sheet inverter including:

a diverter gate which selectively directs a sheet to at least a first path and a second path;

a first rotatable nip assembly disposed along said first path, said first rotatable nip assembly including a first nip drive roll and a first nip idler roll positioned so as to define a first nip therebetween, a first axis passing through said first nip around which said first nip drive roll and said first nip idler roll rotate; and, a second rotatable nip assembly disposed along said second path, said second rotatable nip assembly including a second nip drive roll and a second nip idler roll positioned so as to define a second nip therebetween, a second axis passing through said second nip around which said second nip drive roll and said second nip idler roll rotate, wherein, said first path includes a first pathway for directing a sheet to said first rotatable nip assembly and a second pathway for receiving the sheet after passing through said first rotatable nip assembly, said first rotatable nip assembly being configured to rotate with a sheet engaged in said first nip so as to invert the sheet between said first pathway and said second pathway, wherein, said second path includes a third pathway for directing a sheet to said second rotatable nip assembly and a fourth pathway for receiving the sheet after passing through said second rotatable nip assembly, said second rotatable nip assembly being configured to rotate with a sheet engaged in said second nip so as to invert the sheet between said third pathway and said fourth pathway, a paper feed path positioned to direct paper into said inverter; and a paper outlet path, spaced from said paper feed path, positioned to receive paper from said inverter, and forward to a next stage in the document processing process.

* * * * *